US010125631B2

(12) United States Patent
Evans

(10) Patent No.: US 10,125,631 B2
(45) Date of Patent: Nov. 13, 2018

(54) FAN TRACK LINER ASSEMBLY

(71) Applicant: ROLLS-ROYCE plc, London (GB)

(72) Inventor: Dale Edward Evans, Derby (GB)

(73) Assignee: ROLLS-ROYCE plc, London (GB)

( * ) Notice: Subject to any disclaimer, the term of this patent is extended or adjusted under 35 U.S.C. 154(b) by 560 days.

(21) Appl. No.: 14/855,723

(22) Filed: Sep. 16, 2015

(65) Prior Publication Data

US 2016/0097300 A1 Apr. 7, 2016

(30) Foreign Application Priority Data

Oct. 2, 2014 (GB) ..... 1417416.3

(51) Int. Cl.
*F01D 21/04* (2006.01)
*F01D 25/24* (2006.01)

(52) U.S. Cl.
CPC ..... *F01D 21/045* (2013.01); *F01D 25/24* (2013.01); *F01D 25/246* (2013.01); *F05D 2220/36* (2013.01)

(58) Field of Classification Search
CPC ..... F01D 21/045; F01D 21/04; F01D 25/24; F01D 25/243; F01D 25/246; F01D 25/28; F01D 11/125; F01D 11/127; F02K 1/827; F05D 2250/283; F05D 2220/36; F05D 2240/14; F05D 2240/11; F05D 2230/51; F05D 2230/60; F04D 29/526; F04D 19/002; F05B 2260/3011; F02C 7/05
See application file for complete search history.

(56) References Cited

U.S. PATENT DOCUMENTS 4,149,824 A * 4/1979 Adamson ..... F01D 21/006 415/197
4,411,589 A * 10/1983 Joubert ..... F01D 21/045 415/121.2

(Continued)

FOREIGN PATENT DOCUMENTS

EP 2 141 337 A2 1/2010
EP 2 620 652 A1 7/2013

(Continued)

OTHER PUBLICATIONS

Feb. 4, 2016 Search Report issued in European Patent Application No. 15 18 5411.

(Continued)

*Primary Examiner* — Justin Seabe
*Assistant Examiner* — Joshua R Beebe
(74) *Attorney, Agent, or Firm* — Oliff PLC

(57) ABSTRACT

A fan track liner assembly for ducted fan engine which provides for reduced strain and deformation of front of fan case in the event of a fan blade off event. Various assemblies are proposed. In one aspect, assembly includes fan track liner panel and plurality of fasteners which are arranged to secure panel to fan case of engine, wherein: a forward portion of panel includes hinged portion which operates as trapdoor to permit blade or blade fragment to pass through, and fasteners are arranged to fail in the event of blade or blade fragment passing through trapdoor causing panel to be displaced rearwards in fan case. Other aspects provide for reduced height of support on fan case for attaching fan track liner and for collapsible comb box.

23 Claims, 4 Drawing Sheets

(56) References Cited

U.S. PATENT DOCUMENTS

| | | | | |
|---|---|---|---|---|
| 4,648,795 | A * | 3/1987 | Lardellier | F01D 21/045 415/173.4 |
| 5,188,505 | A * | 2/1993 | Schilling | F01D 21/045 415/200 |
| 7,338,250 | B2 * | 3/2008 | Martindale | F01D 21/045 415/119 |
| 2005/0271503 | A1 * | 12/2005 | Harper | F01D 21/045 415/170.1 |
| 2006/0034682 | A1 * | 2/2006 | McMillan | F01D 21/045 415/173.4 |
| 2006/0269402 | A1 * | 11/2006 | Beckford | F01D 21/045 415/173.1 |
| 2008/0069688 | A1 * | 3/2008 | Harper | F01D 21/045 415/196 |
| 2013/0136577 | A1 * | 5/2013 | Evans | F01D 21/045 415/9 |

FOREIGN PATENT DOCUMENTS

| | | |
|---|---|---|
| EP | 2 620 653 A1 | 7/2013 |
| EP | 2 620 654 A1 | 7/2013 |
| EP | 2 940 283 A1 | 11/2015 |

OTHER PUBLICATIONS

Mar. 31, 2015 Search Report issued in British Application No. 1417416.3.

* cited by examiner

Axial Cross Section

FAN TRACK LINER ASSEMBLY

FIELD OF THE INVENTION

The present invention relates to an assembly for a fan track liner for a fan engine. It is particularly, but not exclusively, concerned with an assembly for a fan track liner to be used in ducted fan gas turbine engines.

BACKGROUND OF THE INVENTION

Turbofan gas turbine engines for powering aircraft generally comprise inter alia a core engine, which drives a fan. The fan comprises a number of radially extending fan blades mounted on a fan rotor which is enclosed by a generally cylindrical fan casing.

To satisfy regulatory requirements, such engines are required to demonstrate that if part or all of a fan blade were to become detached from the remainder of the fan, that the detached parts are suitably captured within the engine containment system.

It is known to provide the fan casing with a fan track liner which together incorporate a containment system, designed to contain any released blades or associated debris. FIG. 1 shows a partial cross-section of such a casing and fan track liner.

In the event of a "fan blade off" (FBO) event, the detached fan blade 18 travels radially outward and forwards. In doing so, it penetrates the attrition liner 110. It may also penetrate the septum 112 and aluminium honeycomb layer 114 before engaging the hook 118. The fan track liner must therefore be relatively weak in order that any released blade or fragment thereof can pass through it essentially unimpeded and subsequently be trapped by the fan casing.

In addition to providing a blade containment system, the fan track liner includes an annular layer of abradable material which surrounds the fan blades. During operation of the engine, the fan blades rotate freely within the fan track liner. At their maximum extension of movement and/or creep, or during an extreme event, the blades may cut a path into this abradable layer creating a seal against the fan casing and minimising air leakage around the blade tips.

The fan track liner must also be resistant to ice impact loads. A rearward portion of the fan track liner is conventionally provided with an annular ice impact panel. This is typically a glass-reinforced plastic (GRP) moulding which may also be wrapped with GRP to increase its impact strength, or simply higher density honeycomb and tougher attrition material defining an ice impact zone. Ice which forms on the fan blades is acted on by both centrifugal and airflow forces, which respectively cause it to move outwards and rearwards before being shed from the blades.

The geometry of a conventional fan blade is such that the ice is shed from the trailing edge of the blade, strikes the ice impact panel and is deflected without damaging the panel.

Swept fan blades are increasingly used in turbofan engines as they offer significant advantages in efficiency over conventional fan blades. Swept fan blades have a greater chord length at their central portion than conventional fan blades. This greater chordal length means that ice that forms on a swept fan blade follows the same rearward and outward path as on a conventional fan blade but may reach the radially outer tip of the blade before it reaches the trailing edge. It will therefore be shed from the blade tip and may strike the fan track liner forward of the ice impact panel within the blade off zone.

The liner used with a swept fan blade is therefore required to be strong enough to resist ice impact whilst allowing a detached fan blade to penetrate and be contained therewithin.

In recent years there has been a trend towards the use of lighter fan blades, which are typically either of hollow metal or of composite construction. These lighter blades have a similar impact energy per unit area as an ice sheet, which makes it more difficult to devise a casing arrangement that will resist the passage of ice and yet not interfere with the trajectory of a released fan blade.

An Aluminium-Kevlar soft wall casing system is currently the preferred solution for corporate applications based upon cost and weight. This includes a fan track liner within the posting chamber that is exposed to the fan blade—allowing tighter tip clearance and rotor out of balance (OOB) orbit with a fused structure post fan blade off (FBO) similar to existing hard wall casings.

Given the presence of a liner system on a soft wall casing it is believed that the fundamental issue of swept blade penetration of a robust liner (ice impact worthy), exacerbated by part speed part fragment, post FBO is as discussed above. With a fan blade typical of this engine sector the aerofoil projectile is even less able to penetrate.

If the aerofoil buckles and the tip breaks off before penetration or the released fragment is smaller or the released fragment occurs at part speed, it is possible, based upon test experience, that the fragment will eject forwards through the intake. The certification authorities now expect evidence that this threat has been addressed by the design.

Even if the blade is robust enough to penetrate the liner and allow the soft wall system to function as intended (a blade retained by the Kevlar band), the part speed part fragment threat remains. Therefore, there is a need for a design that allows these fragments to post into the chamber provided and be retained there even if otherwise the casing acts as a hard wall system.

Containment analysis of trapdoor fan track liners has shown that many of the concepts successfully direct the release blade LE tip behind the fan case fence. However it has become apparent that (a) excessive plastic strain and deformation is directed towards the front of the fan case (which would require fan case and intake reinforcement increasing system weight) and (b) the leant forward attitude taken by the release blade causes it to interact differently with the trailing blade in turn causing premature failure of the latter (which reduces the time the trailing blade imposes a rearward force on the release blade increasing the likelihood of blade fragments being ejected forward through the intake). Whilst trapdoors in the initial FBO phase provide direction of the fan blade LE tip behind the fence, further provision is needed in order to 'square up' the orientation of the release blade to the fan case barrel and address factors (a) and (b) above. The present invention aims to solve one or both of these problems.

SUMMARY OF THE INVENTION

At their broadest, aspects of the present invention seek to improve the crushability of the fan track liner at its mid span.

The principles of the fan track liner assemblies according to these aspects can be applied to all trap door concepts.

A first aspect of the present invention provides an assembly for a fan track liner in a ducted fan engine, the assembly including a fan track liner panel and a plurality of fasteners which are arranged to secure said panel to the fan case of the engine, wherein: a forward portion of said panel includes a hinged portion which operates as a trapdoor to permit a blade or blade fragment to pass through it, and the fasteners are arranged to fail in the event of a blade or blade fragment passing through said trapdoor thereby causing the panel to be displaced rearwards in the fan case.

The fan track liner assembly according to the present aspect can provide for a collapsing bridge type function after the initial FBO phase by failure of the fasteners. This can square up the orientation of a released blade or blade fragment to reduce the strain on the forward portion of the fan case and avoid negative interaction between the released blade or blade fragment and a trailing blade.

Optional and preferred features of the invention will now be set out. These are applicable singly or in any combination with any aspect of the invention.

Preferably the assembly further includes a plurality of separate support pillars which are arranged to support a rear portion of the panel against the case. These support pillars can provide additional support to the rear portion fan track liner against ice impact, whilst allowing the profile of the rear hook (or other similar attachment point) to which the fan track liner is attached to be reduced, thus facilitating the rearward collapse of the liner. The separate support pillars can themselves move in a collapse and so do not impede the rearward motion of the liner in those circumstances.

In a development of this aspect, the assembly further includes a comb box (described as such because the axial cross section looks similar to a comb) having a plurality of circumferential slots separating a plurality of circumferential ribs. This comb box can replace a portion of the liner towards the rear and, when assembled, preferably lies between the liner and the fan case.

The ribs can provide the necessary radial support for ice impact on the liner. Once the fasteners have failed, the comb box can convert the axial rearward motion of the liner into radial collapse of the ribs in the comb box. The rearward motion of the liner can cause the ribs to collapse in domino fashion which allows the whole liner to displace radially outwards.

Preferably the comb box is formed from injection moulded plastic material. This allows the ribs and slots to be formed around the circumferential width of the liner or liner panels. In alternative embodiments, the comb box could be machined from a block of plastic, or formed by machining a honeycomb sandwich.

In certain embodiments, the axial separation of successive slots and the axial thickness of the ribs increases in a rearwards direction. This arrangement provides for greater ice impact integrity towards the rear of the liner where post FBO collapse is less important.

A second aspect of the present invention provides an assembly for a fan track liner for a fan engine, the assembly including: a plurality of panels, a forward portion of said panels including a hinged portion which operates as a trapdoor to permit a blade or blade fragment to pass through it; and a plurality of first fastening members and second fastening members which are arranged to secure the panels to the fan case of the engine, wherein: each first fastening member has: either a substantially C-shaped profile or a substantially T-shaped profile which is arranged to engage with a circumferential rail section located on the fan case; and a fastening portion which is arranged to engage with a second fastening member to secure one of said panels to the fan case.

The assembly of this aspect can allow the radial height of the attachment point (e.g. the mid span hook) on the fan case to which the fan track liner is attached to be significantly reduced, thus reducing the extent to which portions of the fan case act to displace a released blade or blade fragment away from the fan case.

The assembly aspect provides for reduced radial profile of the fan case attachment portions, without requiring holes (e.g. for fasteners) to be provided in the axial portion of the fan case itself.

Preferably each first fastening member has a plurality of fastening portions which are arranged to engage with different second fastening members. This means that a first fastening member can be secured to the fan case, and provide a plurality of attachment points for the panels.

Preferably the first fastening members are arranged to slide on to said circumferential rail section, the assembly further including a plurality of tabs to secure the first fastening members in circumferential position on said rail section.

The assembly of the second aspect may include some, all or none of the above described optional and preferred features in any combination. The assembly of the second aspect may also include the features of the above described first aspect, including some, all or none of the optional and preferred features of that aspect in any combination.

A third aspect of the present invention provides a gas turbine engine having a fan track liner which is formed of a fan track liner assembly according to the above first aspect or the above second aspect, or both, including some, all or none of the optional and preferred features of those aspects.

In some embodiments, where the assembly further includes a plurality of separate support pillars which are arranged to support a rear portion of the panel against the case, the engine may include a further panel located rearward of the fan track liner, wherein the separate support pillars support said fan track liner panels and said further panel. This allows the radial height of the support or attachment portions of the fan case itself to be reduced, and the separate support pillars can themselves move in a collapse and so do not impede the rearward motion of the liner in those circumstances In a development of the above embodiments, there is a void between said further panel and the fan case in the region rearward of the support pillars. This void also assists in reducing the axial resistance to the rearward motion of the liner.

In some embodiments, where the fan track liner is formed of an assembly which includes a comb box having a plurality of circumferential slots separating a plurality of circumferential ribs, the fan case of the engine may have a plurality of circumferential ribs formed on the inner surface which engage with some or all of the slots in said comb box. These circumferential ribs assist the collapse of the comb box ribs by acting as anchors for the comb box slots.

There can be a number of circumferential ribs on the fan case which corresponds exactly to the number of slots in the comb box, or there can be fewer ribs than slots.

In some embodiments wherein the fan track liner is formed of an assembly according to the above described second aspect, the fan case of the engine may have a plurality of said circumferential rail sections formed on the inner surface with gaps between them, such that the first fastening members can be slid onto said rail sections at said gaps.

Preferably the panels of the assembled fan track liner abut around the inner circumference of the fan case of the engine.

The gas turbine engine of the third aspect may include some, all or none of the above described optional and preferred features in any combination.

At their broadest, methods of aspects of the present invention provide methods of assembling or replacing a fan track liner in a gas turbine engine by sliding a plurality of fastening members onto rail structures on the fan case and securing the fan track liner to those fastening members.

A fourth aspect of the present invention provides a method of assembling a fan track liner in a gas turbine engine, the fan track liner including an assembly according to the above second aspect, including some, all or none of the preferred and optional features of that aspect, the method including the steps of: sliding the plurality of first fastening members onto the rail section formed on the fan case of the engine and securing them in circumferential position; and fastening the plurality of panels onto the plurality of first fastening members using the second fastening members, the plurality of panels collectively making up the interior surface of the fan track liner.

A further aspect of the present invention provides a method of replacing a fan track liner in a gas turbine engine in which the replacement liner is assembled in a similar manner to the above described fourth aspect.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
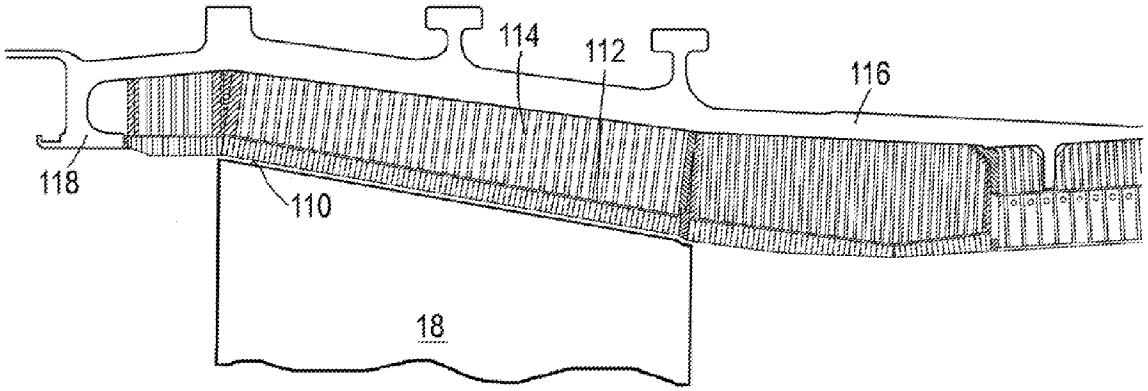
Fig.1 (prior art)
FIG. 1 shows a partial cross-section of a fan casing with a fan track liner and has already been described.
Figure 2:
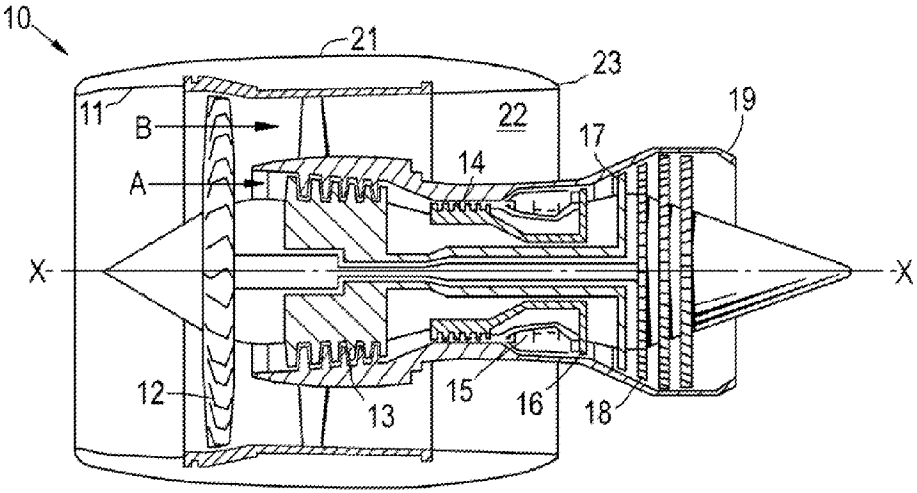
FIG. 2 shows a cross-section through a ducted fan gas turbine engine in which embodiments of the present invention are implemented.

With reference to FIG. 2, a ducted fan gas turbine engine incorporating the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

For the Trent XWB engine produced by Rolls-Royce, the above problems were addressed by providing a fan track liner trapdoor arrangement. The relevant details are set out in earlier Patent applications filed by Rolls-Royce which were not publicly available at the date of filing of the present application, but are summarized here.

Figure 3:
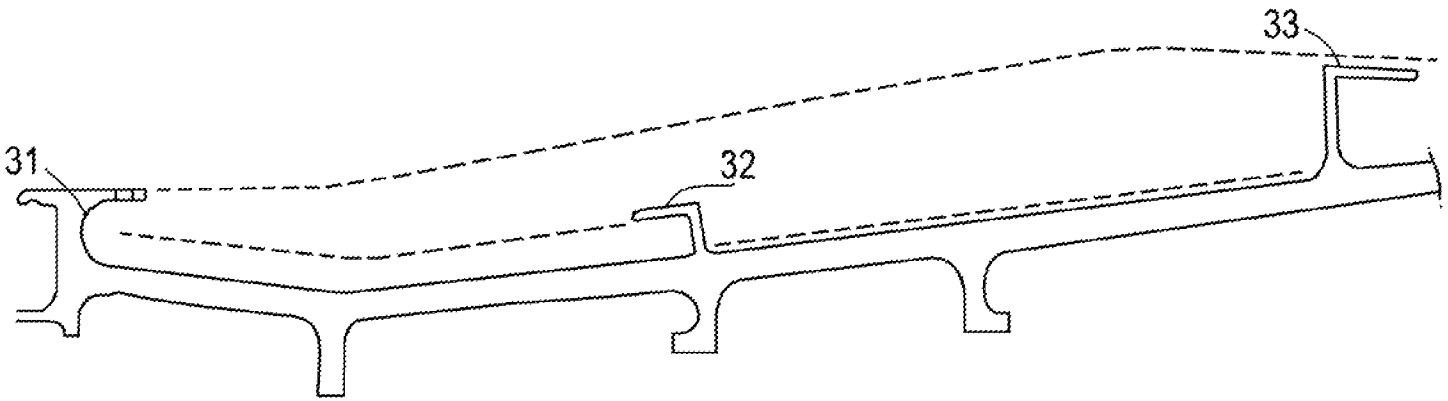
FIG. 3 shows a partial cross-section through the fan casing in the area of fan track liner.

The space envelope for the honeycomb, composite sheet and filler sandwich construction and interface features for this fan track liner are shown in FIG. 3 and has three hooks which provided location surfaces for the fan track liner and trapdoor: a front hook 31, a first rear hook 32 and a second rear hook 33.

Figure 4:
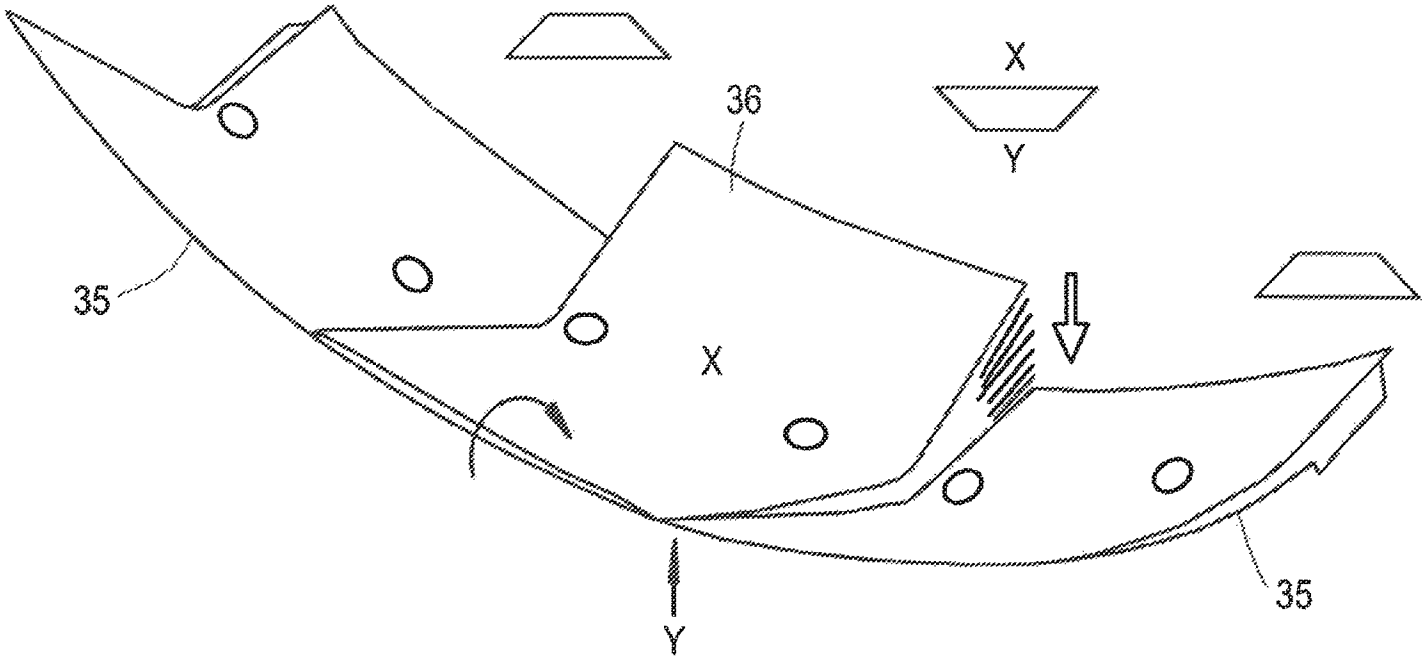
FIG. 4 shows the configuration of the trapdoor panels over a fan track liner.

This concept then acquired a skew to the forward portion that dictates two panel standards for assembly as shown in FIG. 4: a top panel 34 and a bottom panel 35 which alternate around the circumference of the fan track liner.

The basic reasons for introducing a trapdoor concept have been set out above. However when a released fan blade acts on a panel to displace it radially outwards, the adjacent panel presents a step as the fan blade tip in contact with the panel rotates around the annulus. The result is that the blade tip ends up skipping over the containment fence in much the same way as the original problem, particularly passing from bottom panel 35 to top panel 24.

Previously a trapdoor skew was selected which analytically solved the problem until assembly requirements introduced alternating panel interface chamfers (27.5 degrees)—the bottom panel 35-top panel 34 interface didn't work without an adhesive bond and for vibration the extra length presented by the skewed portion resulted in panel vibration issues without an adhesive bond for both interfaces.

Use of an adhesive bond presents issues for both assembly and on-wing repair. The purpose of a cassette fan track liner is to allow airlines to address liner damage quickly and effectively on-wing with minimum disruption. The presence of adhesive undermines this concept both in terms of cure time and bond quality control. It is therefore desirable to provide the benefit of a bolted cassette liner assembly again, allowing a panel tiling effect to avoid inter-panel steps subject to FBO load whilst providing a means of avoiding panel edge vibration. Aspects of the present invention aim to optimise previous solutions which addressed some of the above problems.

Figure 5A:
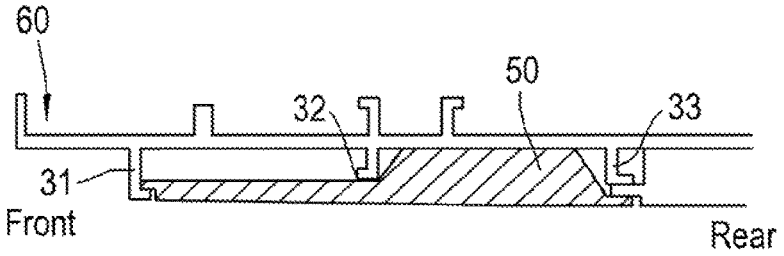
FIGS. 5*a*-5*d* show a fan track liner and a fan track liner assembly according to an embodiment of the present invention.
Figure 5B:
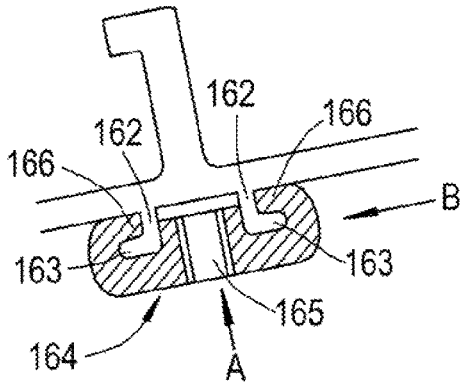
Figure 5C:
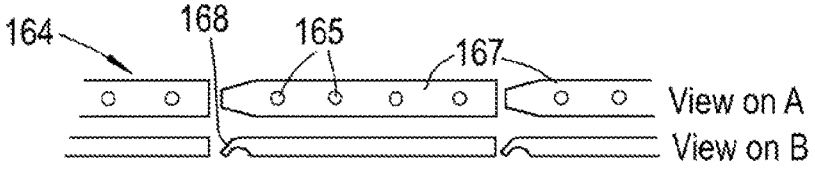
Figure 5D:
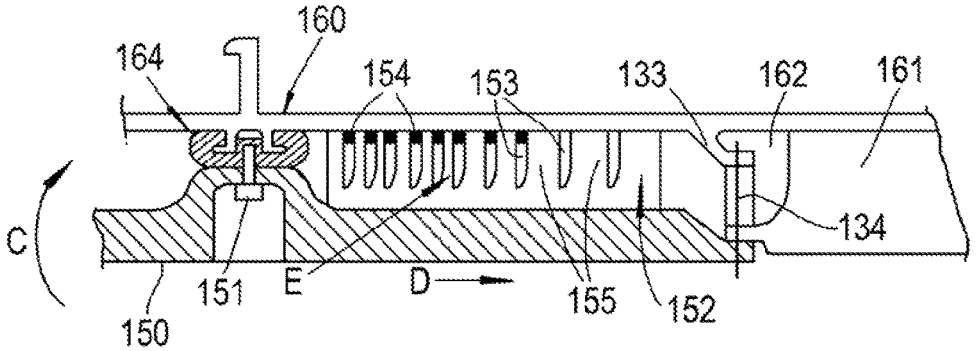

A fan track liner assembly according to an embodiment of the present invention will now be described with reference to FIGS. 5*a*-5*d*. FIG. 5*a* shows an axial cross section through the fan track liner proposed in the earlier patent applications referred to above. FIG. 5*b* shows the detail of the attachment on the fan case forming part of the fan track liner assembly of this embodiment. FIG. 5*c* shows views looking along lines A and B in FIG. 5*b*. FIG. 5*d* shows the fan track liner of the present embodiment assembled on the fan case.

The fan track liner 50 shown in FIG. 5*a* is connected to the fan case 60 by engagement with the hooks 31, 32 and/or 33 and may also be secured by fasteners at these points.

The fan track liner assembly according to this embodiment looks to improve the crushability of the fan track liner at mid span. This concept can be applied to all forms of trapdoors.

In essence, the fan track liner of this embodiment acts firstly as a trapdoor in the known way, but the trapdoor function is followed by a "collapsing bridge" function as explained in more detail below.

To achieve a collapsing bridge the fan track liner has a more crushable mid span portion. Currently the attachment at the mid span hook 32 functions to control vibration of the fan track liner cassette 50. Rearward of this the liner 50 has to be full depth to support the cassette where ice impact is more severe, leading to cassette vibration and self destruction if unsupported. Both ice integrity and basic liner vibration could be affected if the liner depth was reduced behind the mid span hook to generate a void.

The fan track liner of the embodiment shown in FIG. 5*d* has three modifications compared to the fan track liner 50 shown in FIG. 5*a*. Whilst, as shown in FIG. 5*d*, all of these modifications are complimentary and can operate together to provide the improved crushability, they could also be implemented separately, or in different combinations, in other embodiments.

The first modification is that the fan track liner 150 as a whole is arranged such that it is displaced rearwards by the attitude of the released blade. This is made possible by providing a low profile rear attachment hook 133 (compare FIG. 5*a* with FIG. 5*d*). The low profile hook allows the entire fan track liner 150 to be displaced rearwards when an FBO event occurs. Discrete support pillars 134 are provided under the FTL and rear acoustic panel 161 and a void 162 is left to reduce axial resistance to this displacement once the fasteners 151 attaching the fan track liner 150 have failed.

The second modification is a reduction in the radial height of the intermittent mid span hook 32, making it equivalent to a continuous rail to avoid a series of ski jumps displacing the blade tip away from the fan case barrel. This configuration is illustrated in FIGS. 5*b* and 5*c* (and forms part of the general assembly in FIG. 5*d*).

A pair of low profile supports 162 take the place of the mid-span hook 32. These supports 162 are substantially continuous around the circumference of the fan track and each have a hook 163 for engagement with a rail attachment system 164 which has complementary grooves to allow the rail attachment system 164 to be slid onto the supports 162. The rail attachment system 164 is substantially C-shaped in cross-section and comprises two arms 166 which engage with the hooks 163 and a plurality of central fastening portions 165 which are spaced along the circumferential length of the attachment system 164 as shown in FIG. 5*c*.

As shown in FIG. 5*c*, the rail attachment system 164 is formed in a plurality of sections 167 which can be fed onto the hooks via one or more circumferential breaks in the supports around the circumference of the fan case (in these breaks, the circumferential sections of the hooks 163 are missing to allow the flexible strips of the rail attachment system 164 to be fed circumferentially onto the supports 162). Tabs 168 can be used to retain the sections 167 in circumferential position and prevent movement of the rail attachment system 164 during use. The tabs 168 also form an assembly lead in feature which can be bent down after assembly to retain the sections 167. Other known tab arrangements formed on the sections 167 or provided separately could also be used. Alternatively or additionally, the sections 167 may be bonded to the supports 162 by adhesive, or swaged by pressing the arms 166 around the hooks 163. In a further development, the sections 167 could provide a strip of basket nuts instead of the fastening portions 165, i.e. with discrete nuts assembled onto a thinner flexible strip which is assembled onto the supports 162.

The arrangement illustrated in FIGS. 5*b* and 5*c* is considered to be as radially compact as possible without putting holes in the critical axial portion of fan case barrel.

In alternative embodiments, the hooks 163 of the supports 162 may be turned inwards towards each other, rather than outwards away from each other as shown in FIG. 5*b*. In these embodiments, the rail attachment system 164 has a substantially T-shaped profile which is arranged to slot between said hooks and engage with the interior of the hooks.

The third modification is a development of the first modification described above and converts axial motion into radial collapse. This modification is shown in FIG. 5*d*. The rear of the fan track liner 150 is reduced in depth with the gap between the liner 150 and the fan case 160 filled by a plastic injection moulded "comb box" 152 which is bonded to the liner 150. A plurality of slots 153 are formed by the injection moulding between a plurality of wider filament ribs 155 running across the circumferential width of the liner 150. With the liner 150 fastened in place the ribs 155 provide the necessary radial support for ice impact. Post FBO and fastener failure, rearward motion of the liner 150 causes these ribs 155 to collapse in domino fashion allowing the whole liner 150 to displace outwards radially. Comb box rib collapse is aided by a plurality of small interlocking ribs 154 on the inner surface of the fan case barrel 160 that engage with the slots 153 and act as anchors. The whole comb box 152 can be designed to collapse or the ribs can be graded to be more substantial (wider) towards the rear for better ice integrity where post FBO collapse is not essential, as shown in FIG. 5*d*.

In alternative embodiments, the comb box could be machined from a block of plastic, or formed by machining a honeycomb sandwich.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above are hereby incorporated by reference.

The invention claimed is:

1. An assembly for a fan track liner for a fan engine, the assembly including:

a plurality of panels, a forward portion of said panels including a hinged portion which operates as a trapdoor to permit a blade or blade fragment to pass through it; and a plurality of first fastening members and second fastening members which are arranged to secure the panels to a fan case of the engine, wherein:

each first fastening member has:

a substantially C-shaped profile defining an opening configured to receive a circumferential rail section located on the fan case; and a fastening portion which is arranged to engage with one of the second fastening members to secure one of said panels to the fan case.

2. The assembly according to claim 1, further including a comb box configured to be arranged between the fan track liner and the fan case, the comb box having a plurality of circumferential slots separating a plurality of circumferential ribs.

3. The assembly according to claim 2 wherein the comb box is formed from injection moulded plastic material.

4. The assembly according to claim 2 wherein the axial separation of successive slots and the axial thickness of the ribs increases in a rearwards direction.

5. The assembly according to claim 1 wherein each first fastening member has a plurality of fastening portions which are arranged to engage with different second fastening members.

6. The assembly according to claim 1 wherein the first fastening members are arranged to slide on to said circumferential rail section, the assembly further including a plurality of tabs to secure the first fastening members in circumferential position on said rail section.

7. A gas turbine engine having a fan track liner which is formed of an assembly according to claim 1.

8. The gas turbine engine according to claim 7, wherein the assembly includes a plurality of separate support pillars which are arranged to support a rear portion of the panel against the fan case, and wherein the engine includes a further panel located rearward of the fan track liner, wherein the separate support pillars support said fan track liner panels and said further panel.

9. The gas turbine engine according to claim 8 wherein there is a void between said further panel and the fan case in the region rearward of the support pillars.

10. The gas turbine engine according to claim 7, wherein the assembly includes a comb box having a plurality of circumferential slots separating a plurality of circumferential ribs, and wherein the fan case of the engine has a plurality of circumferential ribs formed on the inner surface which engage with some or all of the slots in said comb box.

11. A method of assembling a fan track liner in a gas turbine engine, the method comprising the steps of:

providing the assembly according to claim 1;

sliding the plurality of first fastening members onto the rail section formed on the fan case of the engine and securing them in circumferential position; and fastening the plurality of panels onto the plurality of first fastening members using the second fastening members, the plurality of panels collectively making up the interior surface of the fan track liner.

12. A gas turbine engine having an assembly for a fan track liner in the engine, the assembly comprising:

a plurality of panels, a forward portion of said panels including a hinged portion which operates as a trapdoor to permit a blade or blade fragment to pass through it; and a plurality of first fastening members and second fastening members which are arranged to secure the panels to a fan case of the engine, wherein:

each first fastening member has:

either a substantially C-shaped profile or a substantially T-shaped profile which is arranged to engage with a circumferential rail section located on the fan case; and a fastening portion which is arranged to engage with a second fastening member to secure one of said panels to the fan case;

the fan case of the engine has a plurality of said circumferential rail sections formed on the inner surface with gaps between them, such that the first fastening members can be slid onto said rail sections at said gaps; and the second fasteners are arranged to fail in the event of a blade or blade fragment passing through said trapdoor thereby causing the panel to be displaced rearwards in the fan case.

13. An assembly for a fan track liner for a fan engine, the assembly including:

a plurality of panels, a forward portion of said panels including a hinged portion which operates as a trapdoor to permit a blade or blade fragment to pass through it; and a plurality of first fastening members and second fastening members which are arranged to secure the panels to a fan case of the engine, wherein:

each first fastening member has:

a substantially T-shaped profile which is arranged to engage with a circumferential rail section located on the fan case; and a fastening portion which is arranged to engage with one of the second fastening members to secure one of said panels to the fan case.

14. The assembly according to claim 13, further including a comb box configured to be arranged between the fan track liner and the fan case, the comb box having a plurality of circumferential slots separating a plurality of circumferential ribs.

15. The assembly according to claim 14, wherein the comb box is formed from injection moulded plastic material.

16. The assembly according to claim 14, wherein the axial separation of successive slots and the axial thickness of the ribs increases in a rearwards direction.

17. The assembly according to claim 13, wherein each first fastening member has a plurality of fastening portions which are arranged to engage with different second fastening members.

18. The assembly according to claim 13, wherein the first fastening members are arranged to slide on to said circumferential rail section, the assembly further including a plurality of tabs to secure the first fastening members in circumferential position on said rail section.

19. A gas turbine engine having a fan track liner which is formed of an assembly according to claim 13.

20. The gas turbine engine according to claim 19, wherein the assembly includes a plurality of separate support pillars which are arranged to support a rear portion of the panel against the fan case, and wherein the engine includes a further panel located rearward of the fan track liner, wherein the separate support pillars support said fan track liner panels and said further panel.

21. The gas turbine engine according to claim 20, wherein there is a void between said further panel and the fan case in the region rearward of the support pillars.

22. The gas turbine engine according to claim 19, wherein the assembly includes a comb box having a plurality of circumferential slots separating a plurality of circumferential ribs, and wherein the fan case of the engine has a plurality of circumferential ribs formed on the inner surface which engage with some or all of the slots in said comb box.

23. A method of assembling a fan track liner in a gas turbine engine, the method comprising the steps of:

providing the assembly according to claim 13;

sliding the plurality of first fastening members onto the rail section formed on the fan case of the engine and securing them in circumferential position; and fastening the plurality of panels onto the plurality of first fastening members using the second fastening members, the plurality of panels collectively making up the interior surface of the fan track liner.

* * * * *